US010280609B2

(12) United States Patent
Dhillon

(10) Patent No.: US 10,280,609 B2
(45) Date of Patent: May 7, 2019

(54) HIGH RISE BUILDING ELEVATION CONCEPT

(71) Applicant: Inderjit Singh Dhillon, Middlesex (GB)

(72) Inventor: Inderjit Singh Dhillon, Middlesex (GB)

( * ) Notice: Subject to any disclaimer, the term of this patent is extended or adjusted under 35 U.S.C. 154(b) by 0 days.

(21) Appl. No.: 14/400,543

(22) PCT Filed: May 14, 2013

(86) PCT No.: PCT/GB2013/000216

§ 371 (c)(1),
(2) Date: Nov. 11, 2014

(87) PCT Pub. No.: WO2013/175156

PCT Pub. Date: Nov. 28, 2013

(65) Prior Publication Data

US 2015/0135632 A1 May 21, 2015

(30) Foreign Application Priority Data

May 21, 2012 (GB) ..... 1209006.4

(51) Int. Cl.
*E04B 1/35* (2006.01)
*E04H 12/34* (2006.01)
(Continued)

(52) U.S. Cl.
CPC ..... *E04B 1/3516* (2013.01); *E04B 1/20* (2013.01); *E04B 1/3404* (2013.01);
(Continued)

(58) Field of Classification Search
CPC ..... E04B 1/3404; E04B 1/3516; E04B 2001/3588; E04B 1/35; E04B 1/34; E04B 1/20; E04B 1/3511
See application file for complete search history.

(56) References Cited

U.S. PATENT DOCUMENTS 3,692,446 A * 9/1972 Vanderklaauw ..... 425/63
3,712,008 A * 1/1973 Georgiev et al. ..... 52/79.12
(Continued)

*Primary Examiner* — Adriana Figueroa
*Assistant Examiner* — Jessie T Fonseca
(74) *Attorney, Agent, or Firm* — Young & Thompson

(57) ABSTRACT

The invention is a method to build and erect super high rise buildings with a completely new concept of civil engineering, which is based on concept and method of building of vertical columnar structures by multi stacking of columns using hydraulic suspension and elevator arm system, and then strengthening them with concrete. This is followed with building of gateway support structure around vertical columnar structure and central core to stabilize the high rise building. Next stage is the building of horizontal steel framework platforms at ground level and elevating them by central core elevator and cable hoist system. The passage of horizontal platforms through gateway structure is conducted by alternating opening and closing of gates. The process enables to populate the vertical columnar structures with horizontal platforms, which are then inter locked with vertical columnar structures and central concrete core wall Finally the steel framework platforms are strengthened with concrete.

19 Claims, 16 Drawing Sheets

Figure 1:
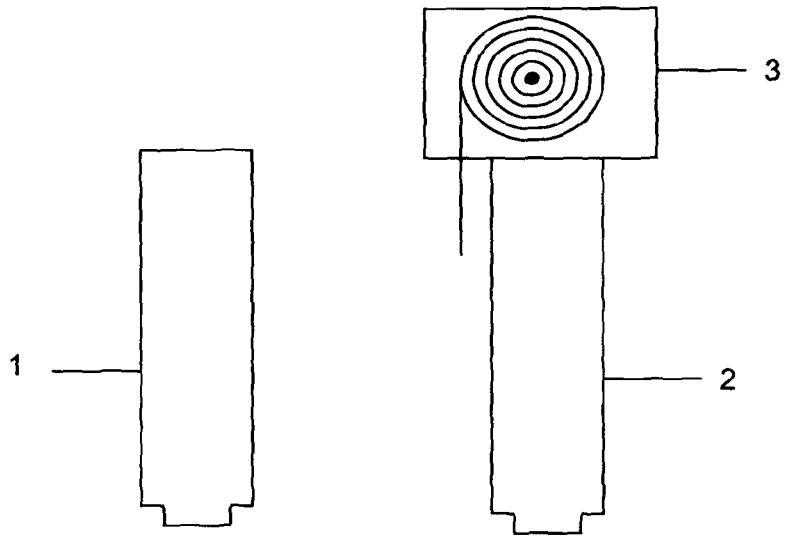

(51) Int. Cl.
*E04B 1/34* (2006.01)
*E04B 1/20* (2006.01)

(52) U.S. Cl.
CPC ..... *E04B 1/3505* (2013.01); *E04B 1/3511* (2013.01); *E04H 12/341* (2013.01); *E04H 12/342* (2013.01); *E04B 2001/3588* (2013.01)

(56) References Cited

U.S. PATENT DOCUMENTS

| | | | | |
|---|---|---|---|---|
| 3,831,902 | A * | 8/1974 | Vanderklaauw | 254/105 |
| 4,656,799 | A * | 4/1987 | Maryon | 52/236.3 |
| 4,736,557 | A * | 4/1988 | Maryon | 52/236.3 |
| 2005/0204687 | A1* | 9/2005 | Raftery et al. | 52/741.1 |
| 2008/0229684 | A1* | 9/2008 | Joung et al. | 52/167.4 |
| 2011/0078976 | A1* | 4/2011 | Abeln et al. | 52/745.02 |

* cited by examiner

HIGH RISE BUILDING ELEVATION CONCEPT

BACKGROUND

The Few centuries ago building construction within major cities such as New York, London and Tokyo was completed by using bricks and mortar only, as there were no lift elevators it was not feasible or possible to build higher than a certain point.

In the late 1800's, new civil engineering methods and technology redefined limits for high rise construction. It became possible to build amazingly high towers. The advancement came with the advent of lift elevators and new steel manufacturing processes which produced long beams. Essentially, architects had a whole new set of building blocks to work with, as relatively narrow, lightweight steel beams could support much more weight than older solid brick constructed buildings limited to height of about ten stories.

Engineers and architects understood that the central support structure of high rise buildings or skyscrapers would have to comprise of both concrete and steel. From the late 1900's till this date high rise buildings have been built using a standard concept of lifting individual steel beam girders by tower cranes delivered to workers assembling them together at each floor level in a vertical and horizontal arrangement. The process is labour intensive and is very slow. A major challenge that high rise construction contractors have to contend with is the factor of 'time'. If a project is not completed by scheduled dates, then huge fines can be imposed and the cost of construction can soar.

The current construction method used to build skyscrapers is to first elevate a central core wall constructed of steel rebar and reinforced concrete. After the core wall has reached a height of approximately ten floors, workers begin to assemble an outer embracing frame of structural steel. The inner concrete core wall is essentially the only part of current day elevated construction. The inner concrete core wall is built from the ground level upwards with a construction lapping zone between the core wall height and the outer embracing steel frame. The inner core wall actually accommodates the most innovative part of the whole process in elevation, it is the hydraulically powered tower crane deck, elevated to a higher level each time the wall is constructed further upwards.

The inner concrete core wall is constructed by simply erecting eight individual steel wall templates and placing a steel rebar cage inside, essentially the steel rebar cage is sandwiched in-between the steel wall templates. Reinforced concrete is then poured inside. After the concrete has settled and hardened, the steel wall templates are removed and shifted upwards to continue the construction of another level. Internal rails are then added bellow on the newly constructed walls allowing the entire tower crane deck to be elevated hydraulically upwards.

The inner concrete core wall is continually constructed and elevated vertically upwards until the complete structure has reached its desired level of height. The inner concrete core wall is built with a higher construction lapping zone than the outer embracing steel frame structure of approximately ten floors. The height discrepancy is maintained throughout the tower construction, as the tower crane deck requires a height advantage in-order to lift the long girder beams from the ground level delivering them upwards to workers assembling them together at each level as an outer-embracing steel frame structure.

The inner concrete core wall also acts as central support structure of the complete constructed building. The outer embraced structural steel frame of vertical and horizontal steel girder beams are secured into the inner core wall, thereby supporting the constructed buildings flexible swaying movements in high winds.

Existing Prior Art

There is prior art on high rise buildings: U.S. Pat. No. 4,656,799 (A) discloses a prism shaped very tall but slender multi-use building having at least, and preferably substantially more than, 100 stories. The main structural element of the building is a hollow, vertical prism of reinforced concrete made up of interconnected, substantially planar, vertical walls. Most of the human-occupied floor space is outside the prism. The prism carries substantially the entire load of the building of approximately 75 floors. JP9067863 (A) discloses a method to construct a super high-rise structure which comprises a plurality of high-rise layers which are a column-shaped building and a plurality of horizontal parts which are spanned between these column-shaped high-rise layers by a plurality of stages. When constructing the high-rise layers, the upper parts of the high-rise layers under construction are covered, and a lift type frame is provided, which supports a construction device which transfers and sets up building materials, on the bottom side. The high-rise layers are constructed under the lift type frame while the lift type frame is moved upward in conformity with the upward construction of the high-rise layers. When constructing the horizontal parts, the upper stage of the horizontal parts is constructed on the top of the lower stage of the pre-constructed horizontal parts. Then, at least the upper stage of the horizontal parts where a structural body is constructed, and is then moved upward and both ends of the upper stage of the horizontal parts on both sides are joined with each other.

RU2380502 (C1) discloses a construction method of high-rise reinforced concrete buildings for example with industrial pipes and towers of small inner diameter. CN1261638 (A) discloses the construction of high-rise building steel structure includes the technological processes of working out construction chart, measuring centre lines and elevation lines of structure components, hoisting, tightening up screw bolts, welding upper layer steel plate, drawing the positioning lines and elevation lines of column, welding beam, spreading pressure steel plates, welding screw bolts, welding column joints, etc. DE3819507 (A1) discloses steel skeleton and/or reinforced-concrete skeleton for high-rise buildings and/or tall high-rise buildings. The steel and concrete structure for high-rise or high buildings, characterized by the flat-modulus reinforcing and the strength and cohesion of the whole enhancing additive structure, consisting of tension members, preferably steel cables and of compression bars, and bars of steel or of high-strength alloy metal. CN102140841 (A) discloses a construction method of a building superstructure in a high-rise steel-concrete mixed structure with few supporting formworks.

CN201236477 (Y) discloses an integral climbing scaffold. CN2128653 (Y) discloses a multifunctional scaffold. CN101845882 (A) discloses a combined device of a mould frame for hanging and casting cement for high-rise buildings and handling and a hanging box for building materials. CN201074327 & CN201074325(Y) discloses an enlarged toe pile for buildings, in particular to an immersed-tube precast enlarged toe pile which is adaptable to high-rise buildings. The device is structurally formed by integrally anchoring and connecting an upper segment precast pre stressed pile body and a lower segment cast-in-situ pile via an upper cast-in-situ concrete base, wherein the lower end of the lower segment cast-in-situ pile body is provided with a cast-in-situ concrete base, the lower segment cast-in-situ pile body is provided with a cross branch, and the upper cast-in-situ concrete base and the cast-in-situ concrete base are internally provided with radical ribs.

U.S. Pat. No. 3,861,103 (A) discloses a partitioning arrangement for high rise buildings comprising floor, ceiling, and side wall runners mounted in coplanar relation, and a panel partition assembly positioned between said runners, in which the panel partition assembly, which comprises studs in the usual spacing having wallboard sheeting secured thereto, rests on the floor runner and is free of fixed connection to all of the runners for floating action relative thereto, whereby the runners are free to shift with the building relative to the panel partition to accommodate flexural movements in the building, due to drift, seismic shock, and the like without distressing the partition in the area of its juncture with the floor, ceiling and side walls.

SU1021741 (A1) discloses method of mounting multi section mainly stepped high rise buildings. The base building section has larger perimeter, with smaller section perimeter building added on top, which allows elevators tall enough to safely move building materials around.

SU962548 (A1) discloses a method of erecting high-rise buildings with rigidity core by the method of floor-lifting. The floors are lifted firstly by diagonally applying hydraulics from outside pillar supports at two opposite corners. This enables whole frame to be elevated by one level. Then second floor frame is similarly lifted. Then the second level is reinforced by building a central core support structure in the centre. This methodology is repeated to lift other levels and at third level the hydraulic lifts are removed and this enables central core structure to be built to elevate floor frames with hydraulic lifting only applicable at top two levels, (a) with hydraulic lift based at top level, and (b) with second top level with both hydraulic lift and central core support, and other built levels only have central support structure.

SU962549 (A1) discloses a method of erecting high-rise buildings by the lifting method. A number of structures are assembled at base, and then each floor structure is elevated up by pulleys and ropes operated from top end of support pillars. Then outside pillars are placed to strengthen the structure. The frame structures are locked into support and peripheral pillars with locking mechanisms.

This invention is to build and erect super high rise buildings with a completely new concept of civil engineering which is firstly to vertically erect a series of columnar structures, secondly to support vertical columnar structures with horizontal structural support gateway zones and finally to assemble horizontal steel framework platforms at ground level and elevate them up the vertically erected columns.

SUMMARY OF INVENTION

The invention is a method to build and erect super high rise buildings with a completely new concept of civil engineering, which is a method of combination of:

a. building of vertical columnar structures by multi stacking of columns, using hydraulic suspension and elevator arm system, and strengthening them with concrete,
b. building of gateway support structure around vertical columnar structure to stabilise the high rise building,
c. building of horizontal steel framework platforms at ground level and elevating them by central core elevator and cable hoist system,
d. passage of the lift elevator and the horizontal platforms through gate opening and closing process for gateway structure, elevation of vertical columnars and to populate vertical columnar structures
e. inter locking of horizontal steel framework platforms with vertical columnar structures and central concrete core wall,
f. strengthening of steel framework platforms with concrete A column module is erected in place, another column with cable hoist is positioned above it and in between a hydraulically powered suspension system is placed which holds a column module.

The hydraulic system is linked or attach to column with cable hoist at top end and to newly erected column at the bottom end.

The opening and closing mechanism of hydraulic suspension system coupled with the movement of hydraulic elevator arms, a new column module/unit is placed in between the top end column module/unit with cable hoist and previously erected column module/unit to provide a method of building vertical columnar structures.

The hydraulic suspension system has elevator arms with a gripper to pickup and to hold a column module.

The lift elevator hydraulic suspensions and hydraulic elevator arms are operated and powered by motorized axel and wheels All column modules have teeth tracks for the lift elevator wheels to run on The column modules are self contained, pre-fabricated and assembled in a factory, are square/cylindrical, symmetrical shaped, consisting of four sided steel templates casing with an internal steel rebar cage.

The column module has an interlocking long screw drive which is held in place by a central rotation machine located at center of it The long screw drive with an aid of rotation machine moves along the screw drive groves located at the top and the bottom end of the column modules.

The central rotation machine is rigidity connected by interconnected rods to steel template Two column modules are securely held in vertical position by interlocking guide steel plates The outer surface of vertical column has got two teeth tracks running at the front and back end of it for the lift elevator to grip and move up and down.

The outer surface of vertical column has got two external rails running at both sides of the columns for lift elevator to move up and down The vertical column four sides have sockets to interlock with beams of horizontal floor platform and the structural support gateway zones A mobile crane is used to place column module with cable hoist which always stay at top end above the firstly erected column module.

The lift elevator moves columns up and down, will collect and hold the column modules on hydraulically powered arms and continually repeat the process of multi-stacking the columns to erect vertical columnar structures.

Concrete is poured into the newly placed columns steel re-bar cage to strength the vertical columnar structure The center concrete core wall structure is built in the centre with tower elevator shaft surrounded by vertical columnar structures The gateway structural support zone are assembled at ground and then elevated by cable hoist and then attached to vertical stacked columns and center core wall at different levels to provide structural integrity to vertically erected columnar structures.

Horizontal platforms are assembled with steel rebar and girdles at ground level and are attached to vertical columnar structures and are elevated vertically by central core lift elevator coupled with cable hoist system.

The gateway zones open upper or lower horizontal gateway connections alternatively, the support gates are opened and the gateway zone is shifted horizontally which allows assess for horizontal platform through one end of the gateway zone, after which opened gate is closed The entire vertically erected columnar structures are populated with floor platforms starting from the top to bottom, whilst gateway structural zones are lowered and removed as the floor platforms are beginning to support the columnar structure at the top.

After the complete erected columnar structure is populated with floor platforms then concrete pouring will commence from the ground level into the steel rebar of the floor platforms will be continued at each floor level upwards to the very top.

The final stage is to cover the entire completed building structure with glass cladding curtain wall.

FIG. 1: a side view of column structures

Figure 2:
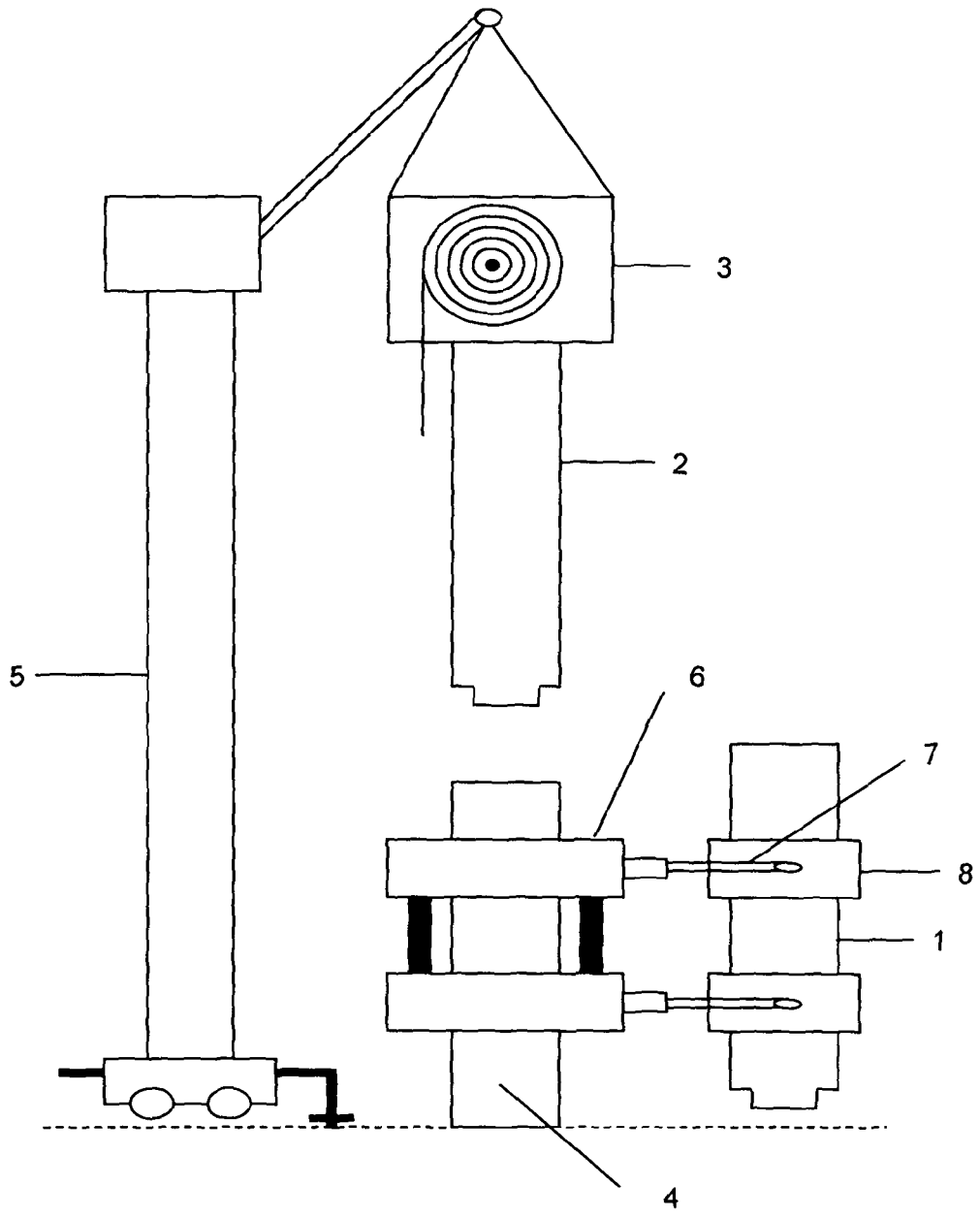

FIG. 2: a side view of installation of first few column structures

Figure 3:
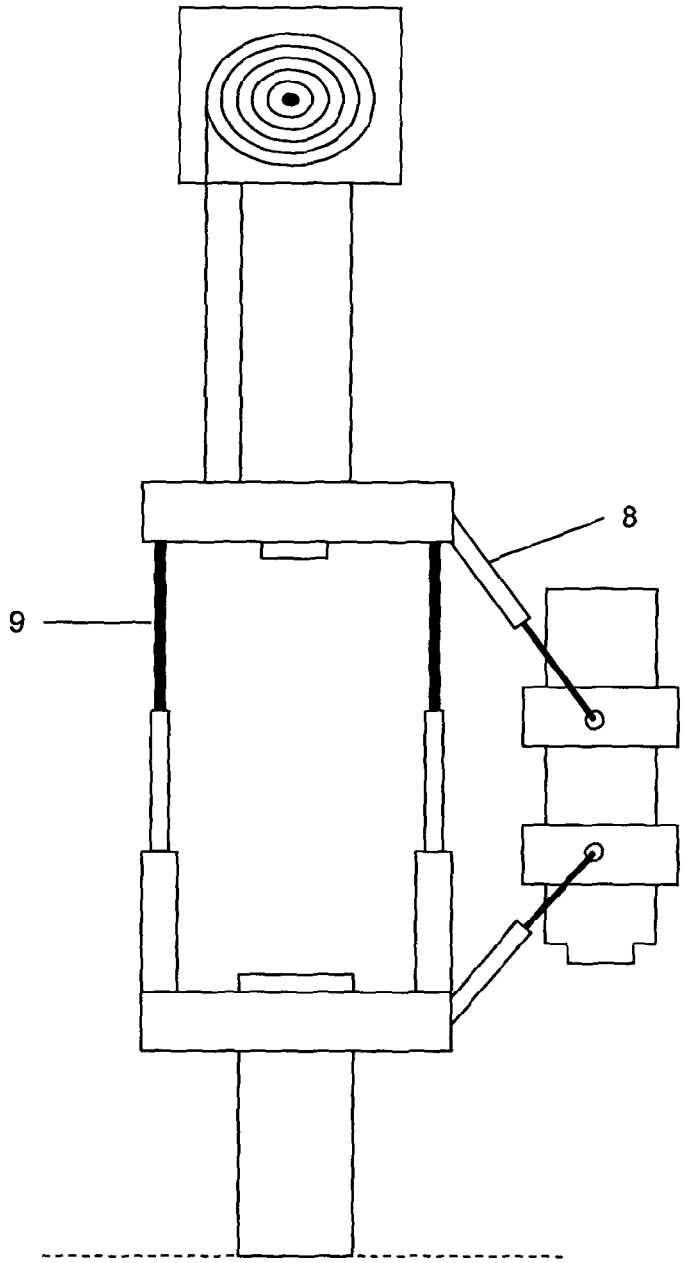
Figure 4:
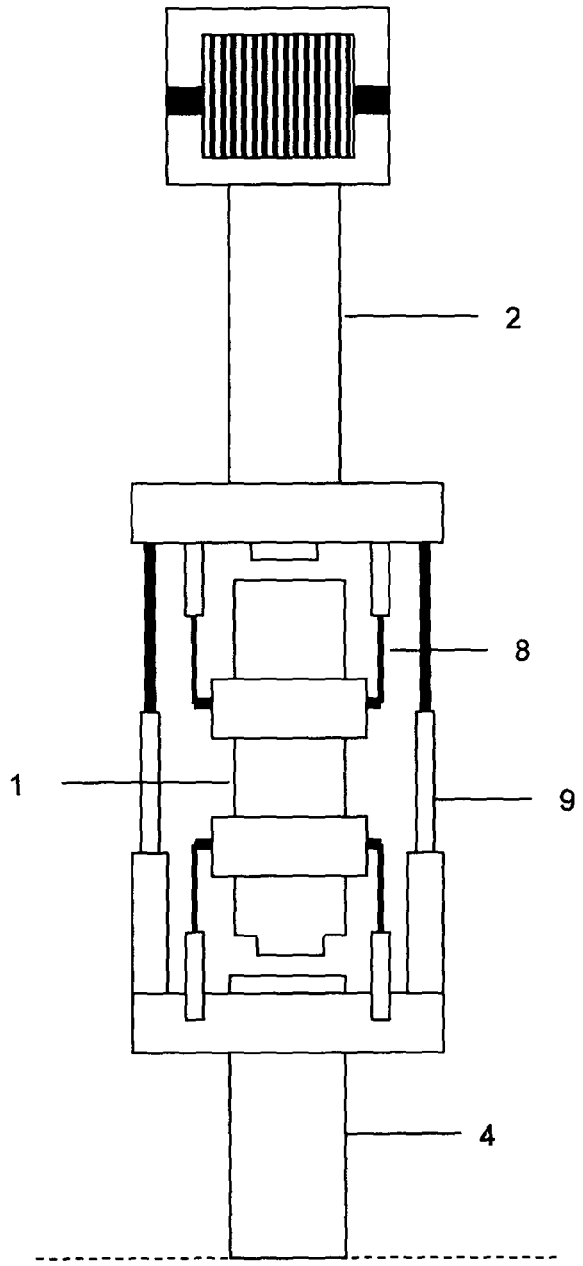
Figure 5:
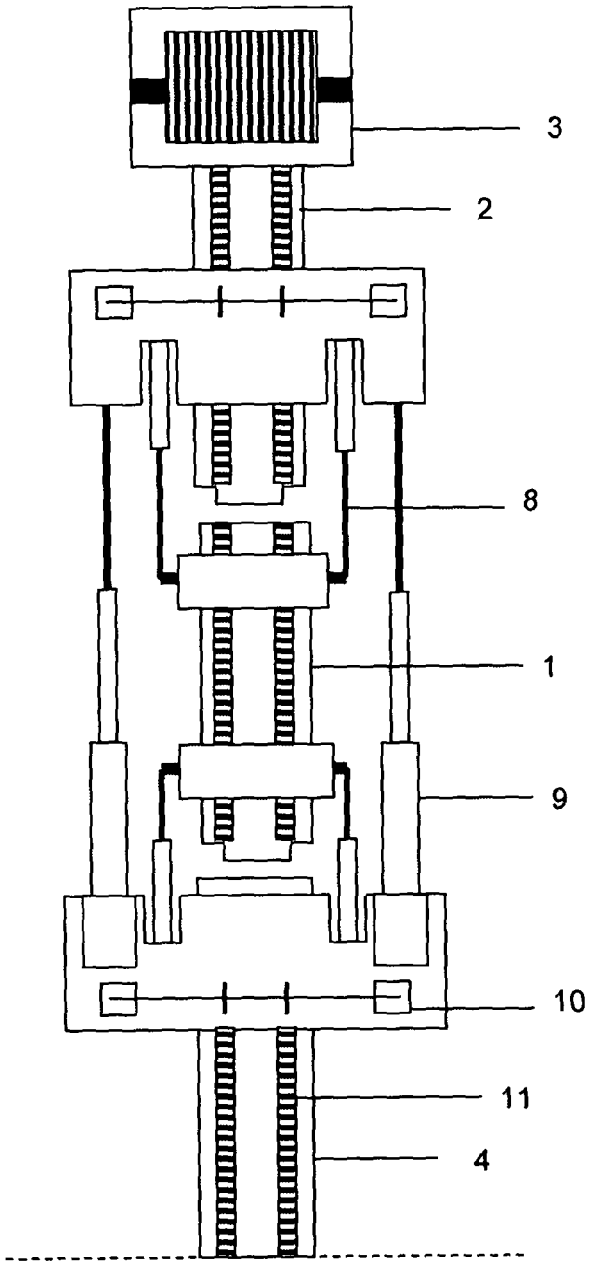
Figure 6:
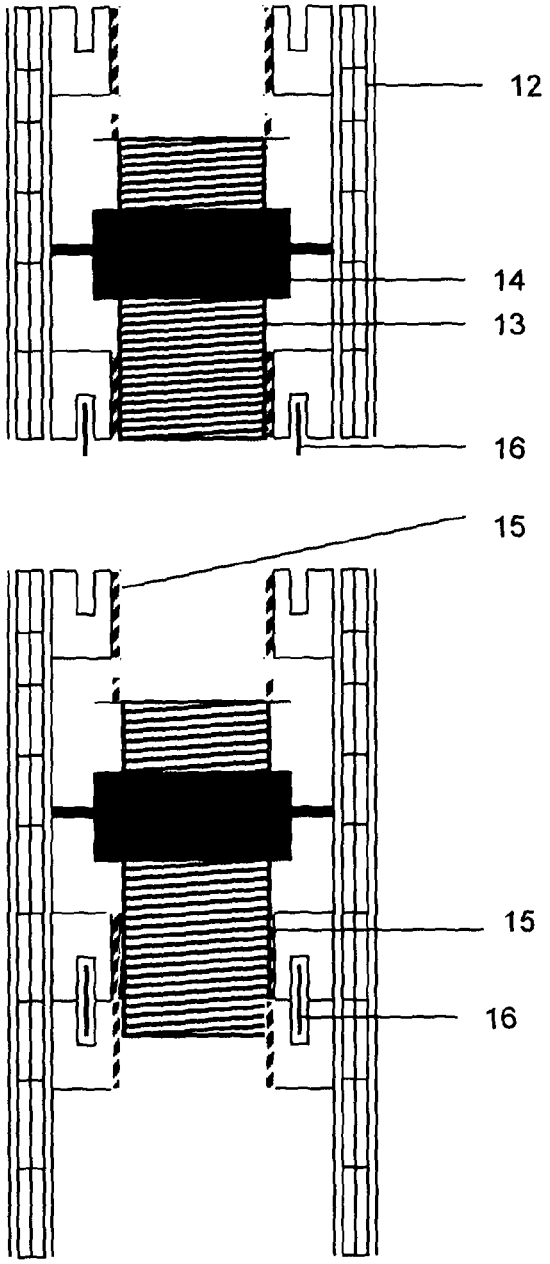
Figure 7:
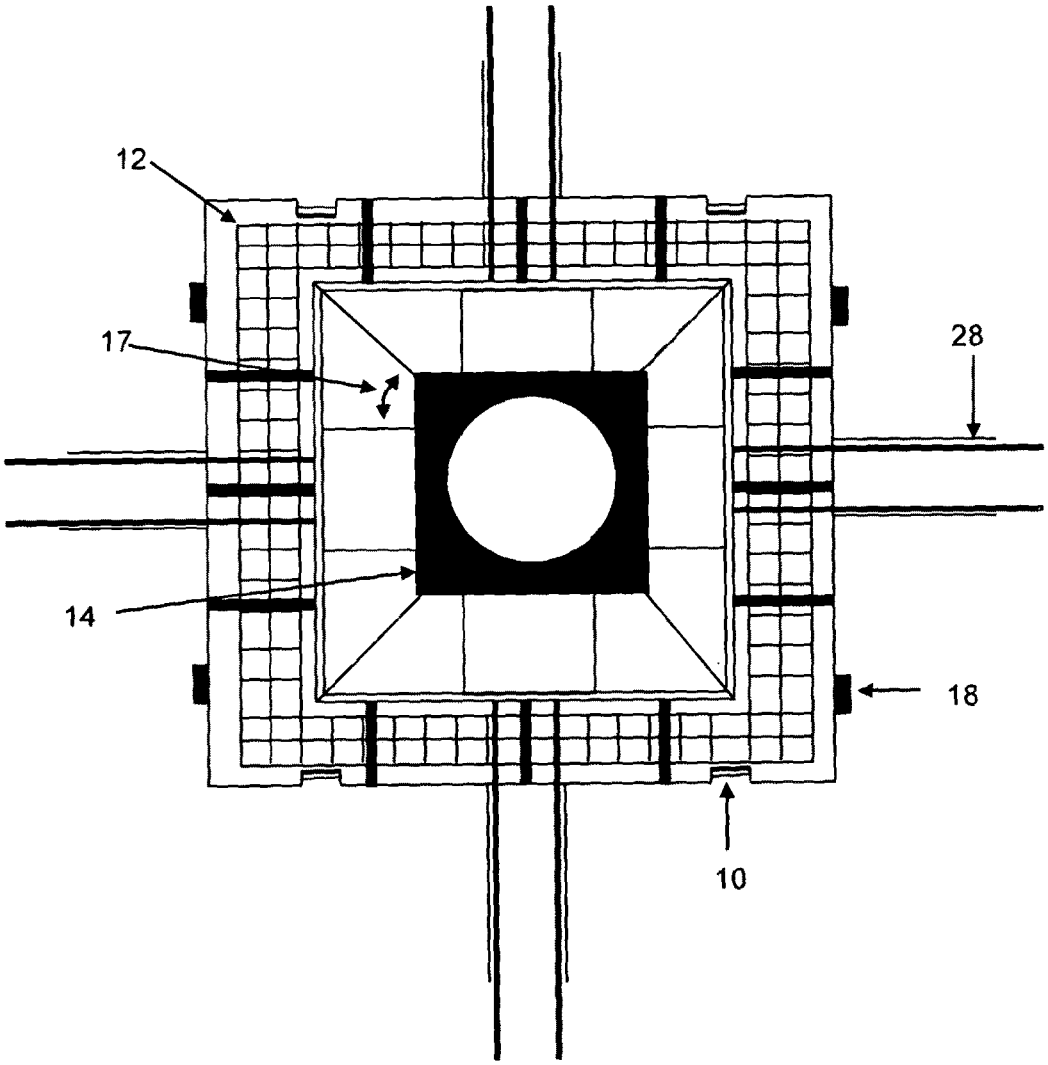
Figure 8:
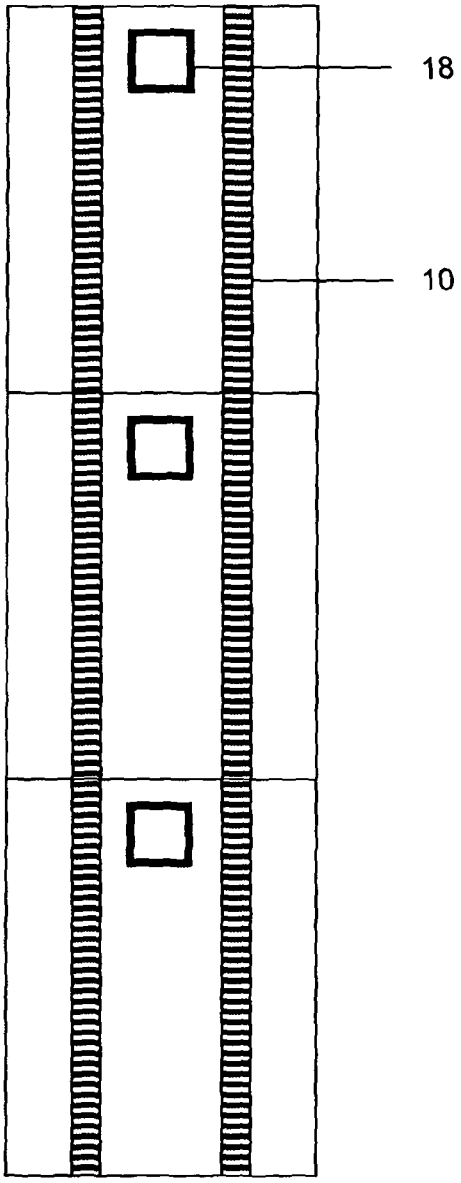
Figure 9:
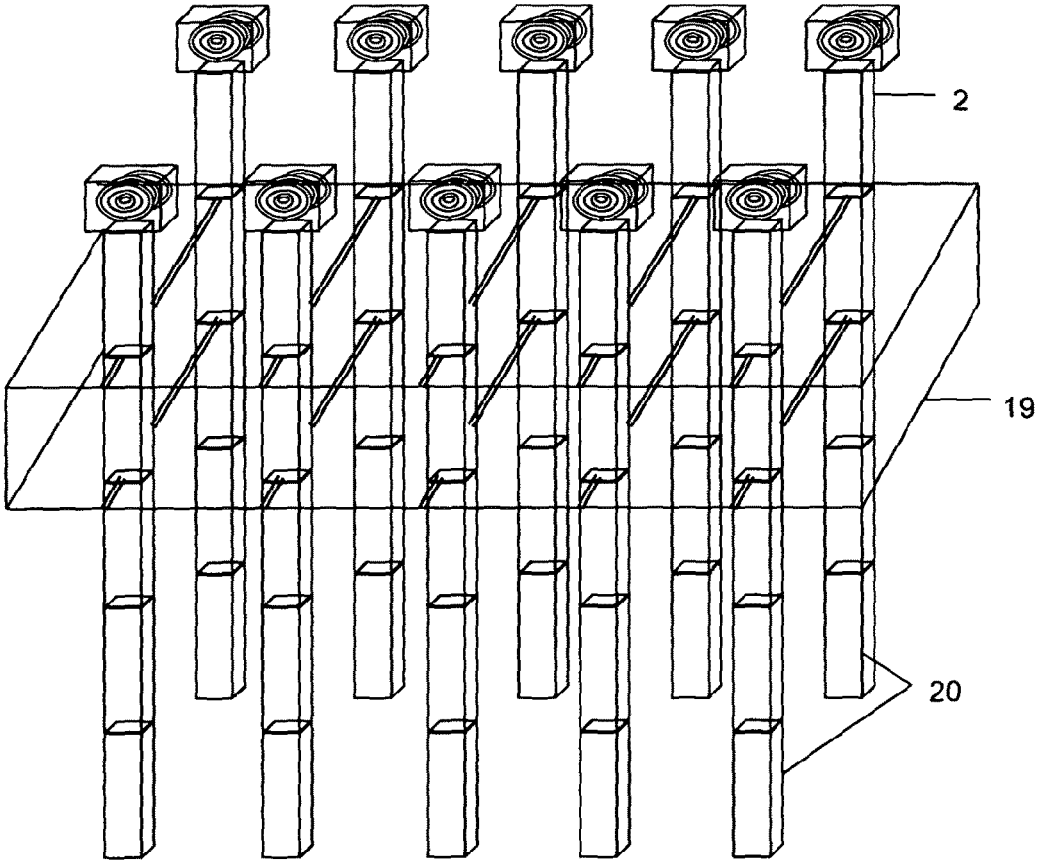
Figure 10:
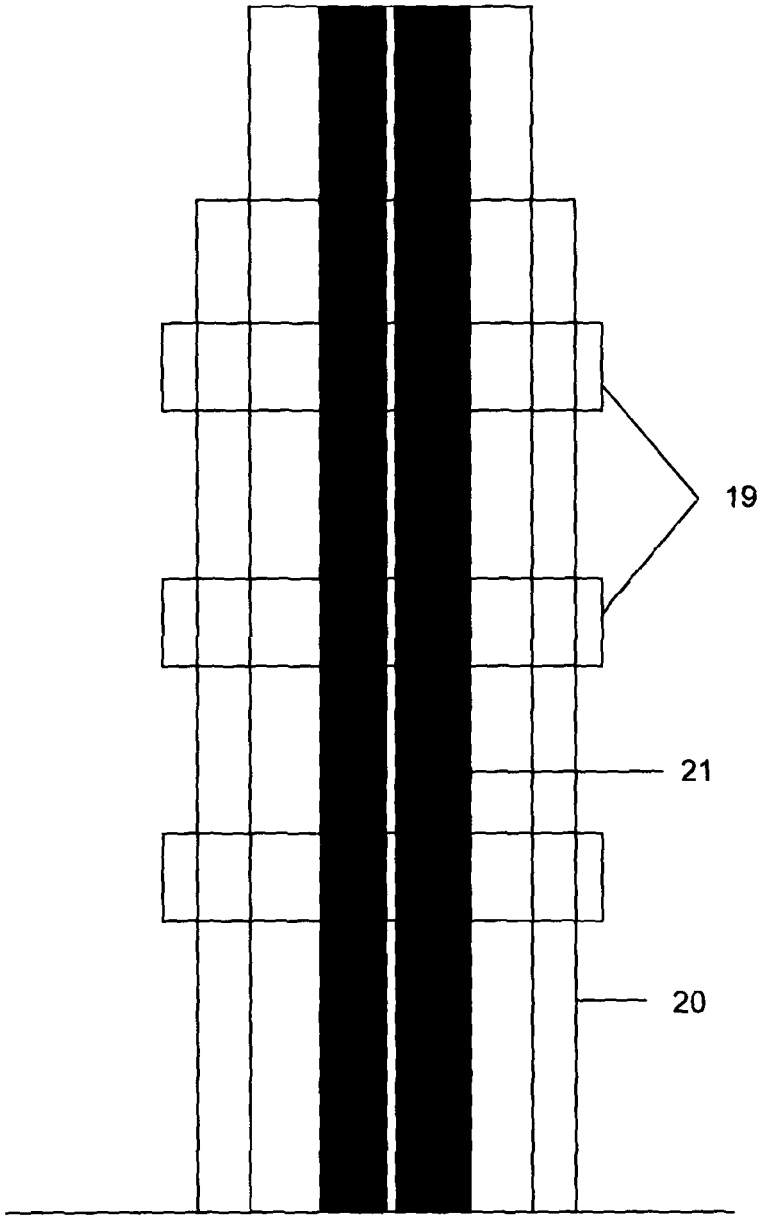
Figure 11:
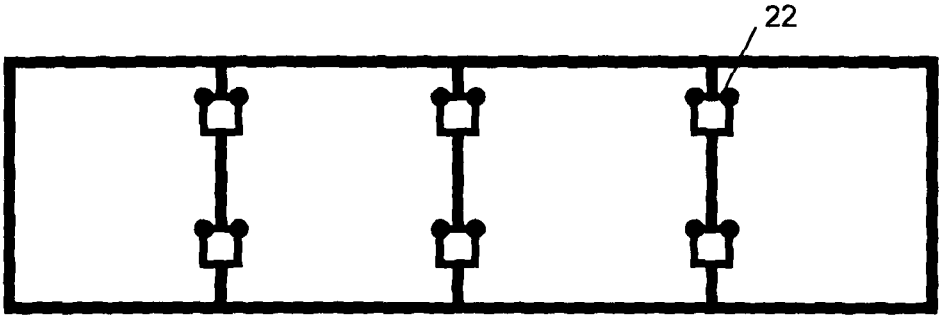
Figure 12:
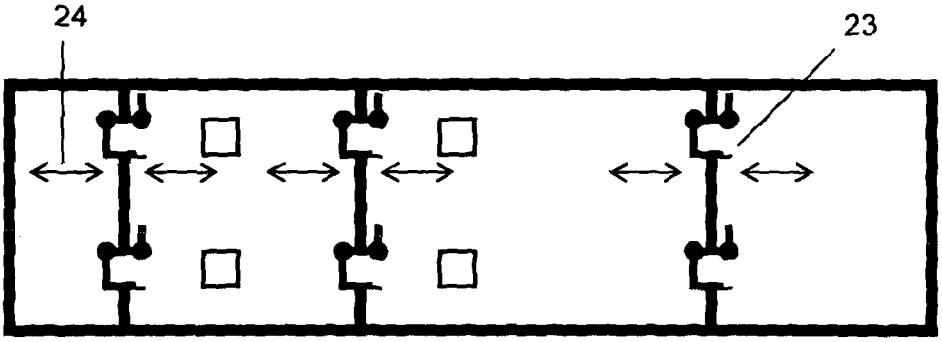
Figure 13:
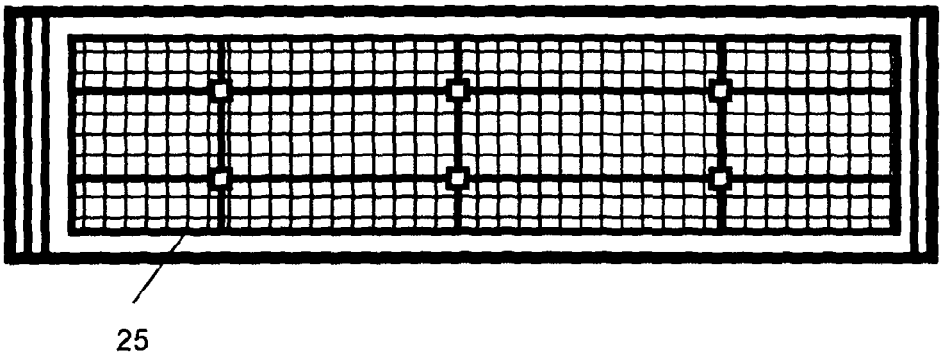

FIG. 3: a side view of installation of new column structure with hydraulic system FIG. 4: a front view installation of new column structure with hydraulic system FIG. 5: a detailed front view installation of new column structure with hydraulic system FIG. 6: a side cross section view of the column FIG. 7: a top cross section view of the column FIG. 8: a front view of stack of columns FIG. 9: a 3 dimensional view of vertical columnar structures, together with the first elevated structural support gateway zone, maintaining support for the erected columnar FIG. 10: a side view of gateway structural zones attached to vertical columnar structures and central concrete core wall FIG. 11: a top cross section view of gateway structural zones attached to vertical columnar structures FIG. 12: a top cross section view of gateway structural zones gate opening closing process FIG. 13: a top cross section view of horizontal platform.

Figure 14:
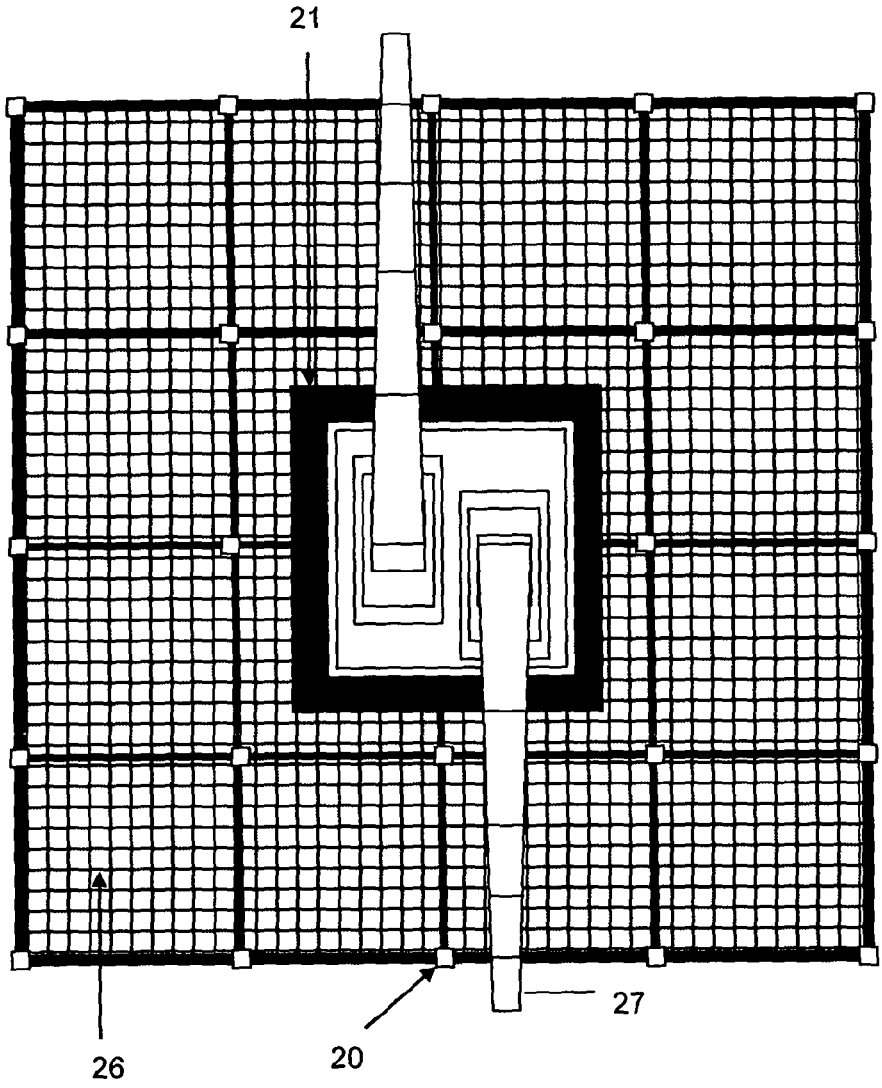
Figure 15:
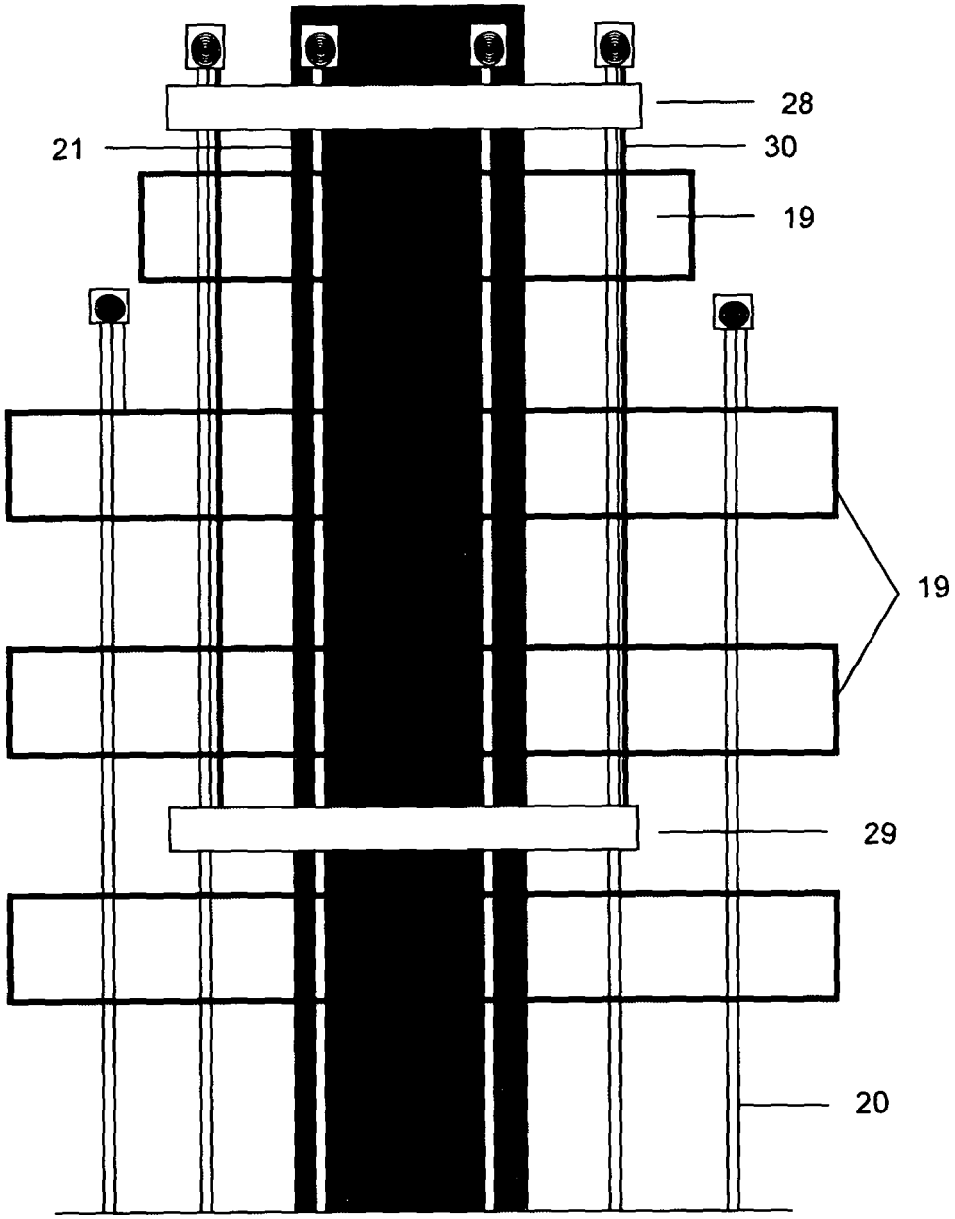
Figure 16:
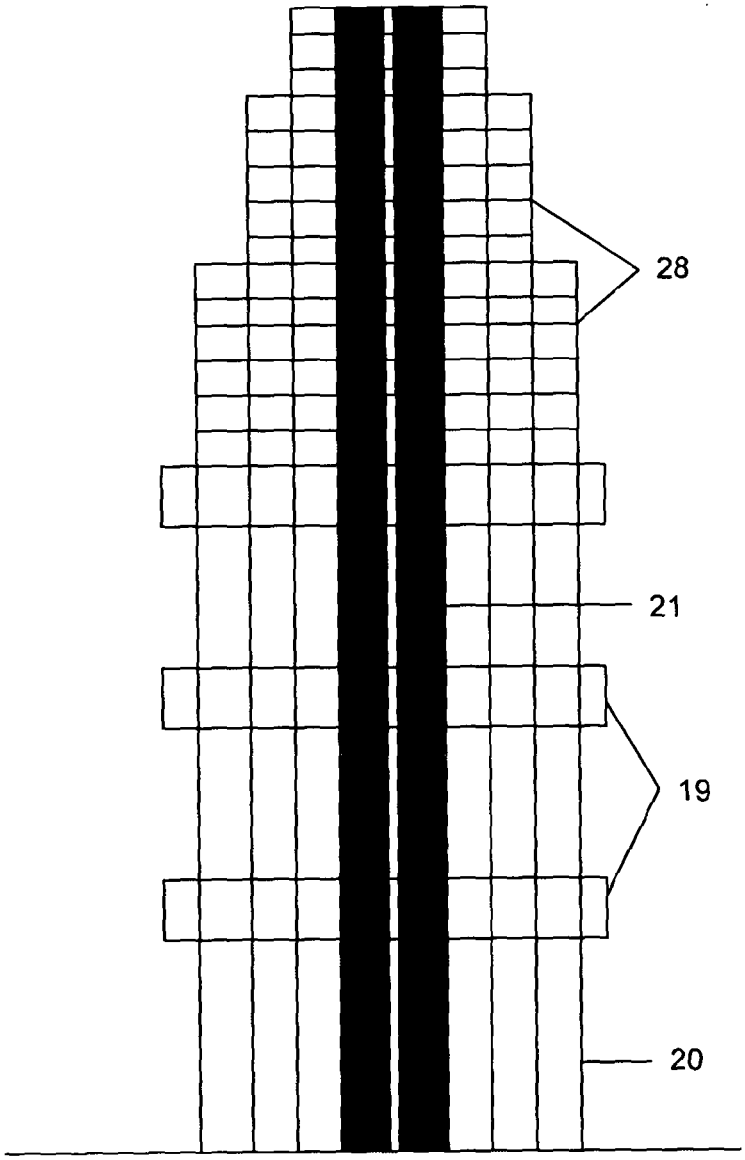
Figure 17:
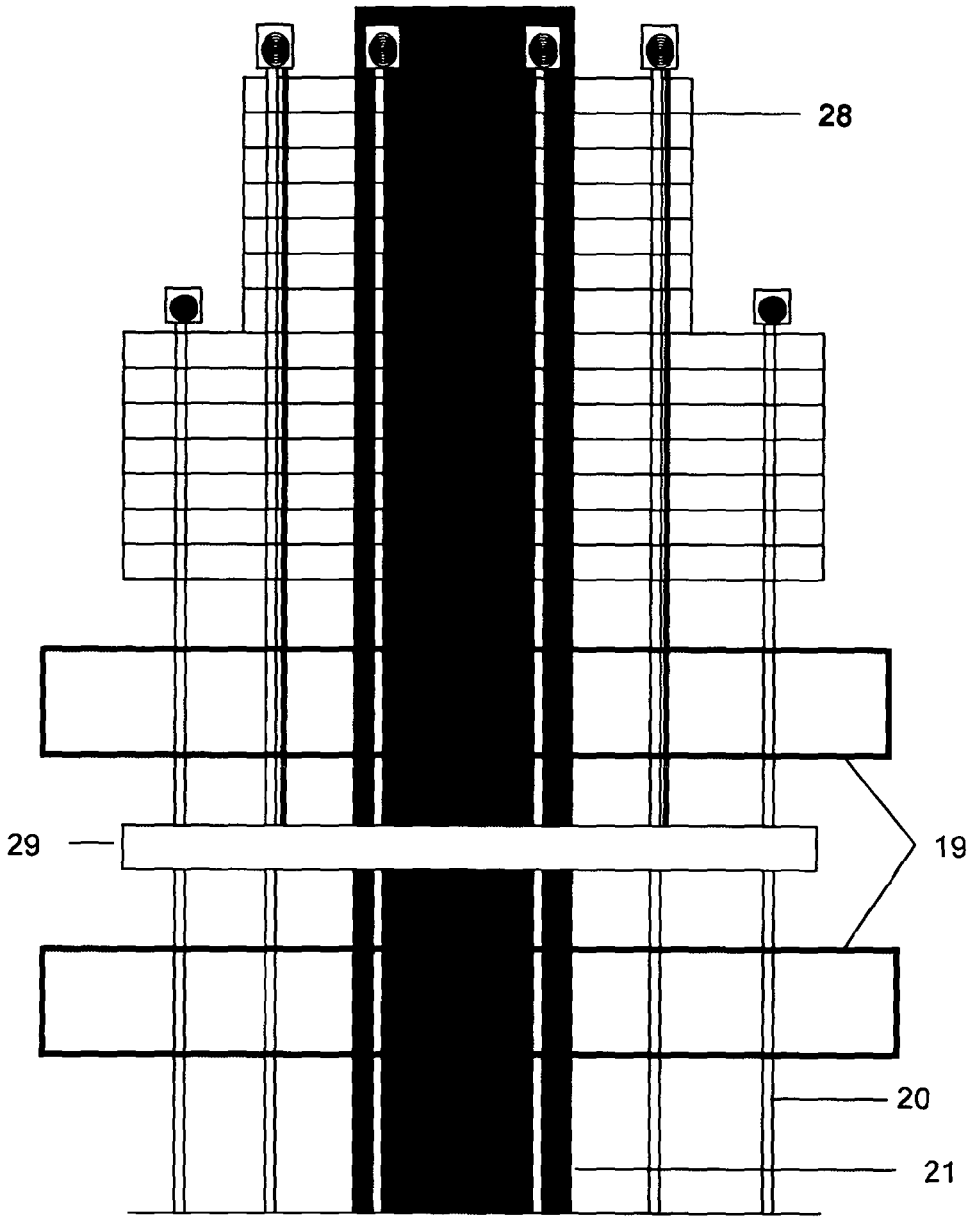
Figure 18:
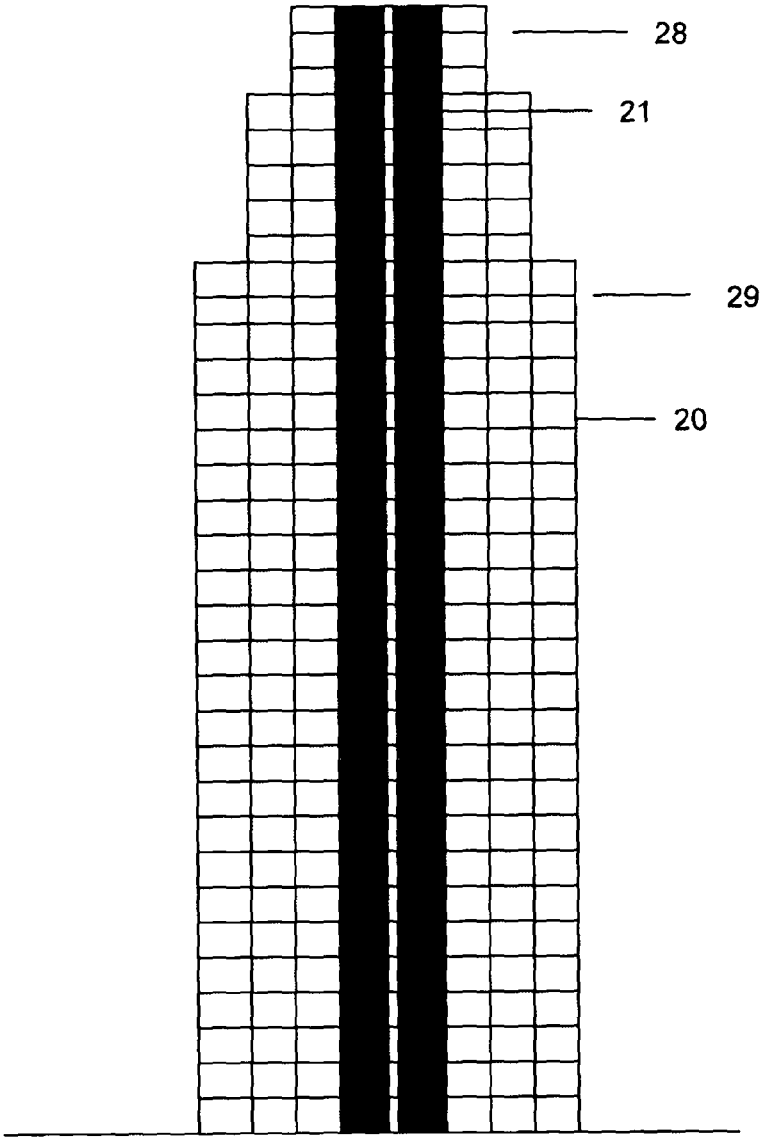

FIG. 14: a top cross section view of horizontal platform attached to vertical columns and central concrete wall core FIG. 15: a side cross section detailed view of central concrete wall core, vertical columnar structure, gateway support zones and first two elevated horizontal platforms FIG. 16: a side cross section view of central concrete wall core, vertical columnar structure, gateway support zones and elevated horizontal platforms FIG. 17: a side cross section detailed view of central concrete wall core, vertical columnar structure, gateway support zones and elevated horizontal platforms FIG. 18: a side cross section view of central concrete wall core, vertical columnar structure, and all horizontal platforms There are two types of mega column modules as shown in FIG. 1; the primary 'multi stack' mega column module (1) and master mega column module (2) with the 'cable hoist' (3) which will always remain at the top and literally replaces the use of current day tower cranes.

FIG. 2 shows an erection of vertical columns utilizing master mega column module (2) and mega column modules (1). Firstly, a mega column module (4) is erected in place. A mobile crane unit (5) then elevates master mega column (2) with cable hoist (3) into position above the erected mega column module (4). Secondly, a hydraulically powered suspension system (6) is placed on top of the erected mega column (4). Thirdly, the hydraulic suspension system (6) which has elevator arms (7) connected to a gripper (8) which is utilized to pickup and to hold a mega column module (1). Fourthly, the hydraulic suspension system (9) opens up as shown in FIG. 3 such that the mega column module (1) can be accommodated between the master mega column module (2) and the erected mega column module (4). In addition, the top end of the hydraulic system (6) is raised into master mega column (2) whilst the bottom end remained attached to the erected mega column (4). The hydraulic elevator arms (8) are moved so that they bring the mega column module inwards and aligns it with both master mega column module (2) and erected mega column (4) as shown in FIG. 4. The hydraulic suspensions (9) and hydraulic elevator arms are operated and powered by motorized axel and wheels (10) as shown in FIG. 5 which is a frontal view with details of column elevation/erection process. All mega column modules (1, 2 & 4) have teeth tracks (11) for elevator wheels to run on as shown in FIG. 5. Finally, the hydraulic system is reverted to its original position with release of gripper (8) which allows mega column module (1) to be inserted between master mega column module (2) and previously erected mega column module (4).

FIG. 6 show the side cross section and the FIG. 7 show the top cross section view of the mega column module. The mega column modules are self contained, pre-fabricated and assembled in a factory. Each mega column will be square or cylindrical, symmetrical shaped, consisting of four sided steel templates (12) casing with an internal steel rebar cage as shown in FIG. 7. Located within the centre of the mega column module is an interlocking long screw drive (13) held in place by a central rotation machine (14). The long screw drive with an aid of rotation machine moves along the screw drive groves (15) which are located at the top and the bottom end of the mega column modules. Two mega column modules are securely held in vertical position by interlocking guide steel plates (16). The central rotation machine is rigidity connected by interconnected rods (17) to steel template (12) as shown in FIG. 7. The outer surface has got two teeth tracks (10) running at front and back end of the mega columns for lift elevator. In addition, the outer surface has got two external rails (18) running at both sides of the mega columns for lift elevator. At the centre of all four sides, there are sockets into which the horizontal beams interlock into mega columns as shown in FIGS. 7 and 8. There are rails (18) and teeth tracks (10) on the external walls of mega column modules, the rails will allow for the lift elevators to run smoothly on the mega column modules and the teeth track will allow for the lift elevator wheels to grip and run vertically up and down on the erected mega column modules. All the vertically erected mega columns will have large socket holes on all four sides. The sockets will form a very unique feature allowing all horizontal components to plug into the vertically erected mega column modules during the entire process of elevation, construction and completion.

The lift elevator will be one of the key modules within the entire innovative process of the building elevation concept. A mobile crane (5) is deployed between the firstly erected mega column module (2) and master mega column module (4), after which the lift elevator is deployed successfully to run vertically up and down to erect mega column modules (1) efficiently.

The lift elevators main operational function will be to collect mega columns modules from the ground and transport them to the top most erected mega column module. The lift elevator will collect and hold the mega column modules on hydraulically powered arms (8) and continually repeat the process of multi-stacking the mega columns. It vertically runs on the pre-set or stacked mega columns whilst carrying mega column module to be further added on to the stacked mega columns.

Each time the lift elevator returns to the top most erected mega column modules (4) the lift elevator will detach the master cable hoist mega column module (2) and temporally suspend it vertically with its hydraulically powered suspensions (9), a space is then created between the suspended master cable hoist mega column module (2) and the vertically erected mega column bellow, the lift elevators hydraulically powered arms (8) then begins to shift the mega column it carries sideways, stacking another mega column on top of the vertically erected mega column bellow.

Once the lift elevator has successfully transported and deployed each mega column, it will then begins to pour concrete into the newly placed mega columns steel re-bar cage (12). At the end of each deployment the lift elevator will re-lower the temporally suspended master cable hoist mega column re-connecting it with the newly permanently deployed mega column. The lift elevator will then return to the ground level to collect another mega column to repeat the process again.

The process will continually be repeated until all the required amount of columnar, have been multi-stacked right up to the desired level of tower height. The lift elevator will run vertically up and down on the erected columnar automated, although controllers on the ground will be able to visually monitor the lift elevators entire operations with the aid of sophisticated technology and cameras.

The gateway structural support zone (19) as shown in FIG. 9 completes an imperatively important operation and that is to maintain the structural integrity of the vertically erected mega columns (20) from swaying in high winds. The supportive gateway zones will keep the mega columns completely stable during the entire process of the structural elevation. The FIG. 9 shows the three dimensional view of a series of multi-stage mega columns together with first elevated structural gateway support zone supporting the erected columns. The supportive gateway zones are assembled onsite. The entire assembled gateway zones are then attached to the vertically erected mega columns rail system and connected to the master mega columns cable hoist system at ground level. The horizontal gateway zones are then elevated up vertically and locked into position at different levels of the erected mega column modules as shown in FIG. 10 which shows the entire structure of vertically erected mega columns with the centre concrete core wall (21) and the horizontal support gateway zones (19). The unique gateway zones will lock onto the vertically erected mega column module lower and upper sockets as shown in FIG. 11 which is a top view of the structural support gateway zone connected to mega columns (22). The gateway zones are able to innovatively open (23) upper or lower horizontal gateway connections separately as shown in FIG. 12. The support gates are opened and begin to shift sideways (24). As one end of the lower or upper horizontal support gateway is connected to the vertical mega columns, access is provided by opening the alternative gate end, the lift elevator or horizontal floor platform (25) is then able to enter into the gateway zone, after entry is made the opened gate is closed and the alternative gate end is opened allowing the lift elevator or floor platform to pass through the zone. FIG. 13 shows assembled platform elevated through the support zone.

The entire vertically erected structure of mega column modules needs to be populated with floor platforms from top to bottom. The steel girder floor platforms as shown in FIG. 14 are assembled at the ground level. Once the platforms have been assembled, the workers will begin to place and secure steel rebar (26) within the girder platforms. The horizontal assembled floor platforms are then attached to the vertical mega column modules (20) together with the master cable hoist system. The platforms is then elevated upwards passing through the structural gateway zones. The platform is then also linked or attached to the center concrete core wall (21) which accommodates the tower crane deck (27).

As the floor platforms are elevated to the top of the erected structure as shown in FIG. 15, where the first floor platform is elevated right to the top of the vertically erected structure. The second floor platform (28) is elevated upwards by master mega column cable hoist system (30). The supportive gateway zone is lowered; this is as the vertically erected mega columns begins to find support from the elevated floor platforms (28, 29). As the top of the erected columnar and centre core wall structure is populated with floor platforms the gateway zones at the lower end of the structure are lowered one by one to the ground and disassembled as shown in FIGS. 16 and 17.

Once the entire structure has been populated with elevated floor platforms from top to bottom as shown in FIG. 18, construction workers begin to install wiring, heating, drainage pipes and ventilation system. When the entire structure has been completed, the reinforced concrete is poured into the steel rebar of the floor platforms, beginning at the ground level floor platform. Concrete pouring into the steel rebar of the floor platforms will be continued at each floor level upwards to the very top.

The final stage is to cover the entire completed building structure with glass cladding curtain wall. This is a standard procedure used in current day tower developments and is very effective as it completes projects with extreme efficiency. Pre-fabricated glass compartments are made in factories and simply delivered to the site and elevated up by tower cranes at the top of the competed structures. The glass cladding units are simply hooked on each floor platform level. The entire tower or skyscraper is then very quickly covered with glass cladding units and is therefore known as the curtain wall system.

The unique innovative concept comprises of reverse civil engineering methods, not previously known or used in high rise building construction procedures. Although, some exiting engineering procedures will be applied which will include the use of elevating the centre core wall (21) as it will still be required for the central support structure and for the passage for the tower elevator shaft once the high rise building has been completed. The use of glass cladding will be used as this is still a very efficient way to cover a complete building structure.

This innovative high rise building elevation concept is highly efficient method of completing the construction of towers or skyscrapers as it reduces average building construction time by about 70%. The cost of construction should also be far less by approximately 60 to 70% than conventional building construction as the concept is far less labour intensive.

The unique concept and methodology should provide a unique and efficient alternative to super high rise building contractors. Local authorities would be more comfortable allowing developers to build super high rise buildings within dense metropolitan areas as construction will be completed in less time.

The invention claimed is:

1. A method of constructing a building, the method comprising:

a. building at least one multi-stacked column by:

(i) suspending with a hydraulic machine an upper column module above a lower column module;

(ii) inserting with the hydraulic machine an intermediate column module between the upper column module and the lower column module;

(iii) securing the intermediate column module to the lower column module, so as to extend the lower column module;

(iv) repeating steps a(i)-a(iii) until a multi-stacked column having a desired height is erected, wherein the multi-stacked column has the upper column module at its top;

b. attaching at least one gateway support structure to the at least one multi-stacked column, wherein the at least one gateway support structure is moveable between a closed position and an open position while remaining attached to the at least one multi-stacked column;

c. building at least one steel framework platform at ground level;

d. lifting the at least one steel framework platform with a cable hoist and passing the at least one steel framework platform through the at least one gateway support structure;

e. locking the at least one steel framework platform to the at least one multi-stacked column; and f. strengthening the at least one steel framework platform with concrete.

2. The method of claim 1, wherein:

step a further comprises, before step a(i), erecting the lower column module, the upper column module comprises the cable hoist, and the hydraulic machine is positioned between the upper column module and the lower column module.

3. The method of claim 2, wherein the hydraulic machine is attached to the upper column module at a top end of the hydraulic machine and to the lower column module at a bottom end of the hydraulic machine.

4. The method of claim 3, wherein:

the hydraulic machine suspends the upper column module above the lower column module by extending the top end of the hydraulic machine attached to the upper column module away from the bottom end of the hydraulic machine attached to the lower column module, thereby creating a space for the intermediate column module between the upper column module and the lower column module.

5. The method of claim 4, wherein the hydraulic machine comprises hydraulic elevator arms that comprise a gripper that picks up and holds the intermediate column module.

6. The method of claim 5, wherein the hydraulic machine and the hydraulic elevator arms are operated and powered by a motorized axel and wheels.

7. The method of claim 1, wherein the lower and upper column modules each comprise teeth tracks configured for lift elevator wheels to run on.

8. The method of claim 1, wherein the lower and upper column modules are:

self-contained, pre-fabricated and assembled in a factory, symmetrical, and comprise four sided steel templates casing with an internal steel rebar cage.

9. The method of claim 8, wherein the lower and upper column modules have an interlocking long screw drive which is held in place by a central rotation machine located at a center of the lower and upper column modules.

10. The method of claim 9, wherein:

the lower and upper column modules further comprise screw drive grooves, located at top and bottom ends thereof, and the central rotation machine moves the interlocking long screw drive along the screw drive grooves; and the central rotation machine is rigidly connected by interconnected rods to the steel template.

11. The method of claim 1, wherein the lower and upper column modules are securely held in a vertical position by interlocking guide steel plates.

12. The method of claim 1, wherein front and back sides of an outer surface of the lower and upper column modules each have two teeth tracks that are configured to cooperate with a lift elevator.

13. The method of claim 1, wherein front and back sides of an outer surface of the lower and upper column modules each have two external rails that are configured to cooperate with a lift elevator.

14. The method of claim 1, wherein four sides of the lower and upper column modules comprise sockets configured to interlock with beams of a horizontal floor platform and the gateway support structure.

15. The method of claim 2, further comprising:

using a mobile crane to place each upper column module;

using the hydraulic machine to move the intermediate and upper column modules up and down, and to collect and hold the intermediate and upper column modules on the hydraulic machine; and strengthening the multi-stacked column by pouring concrete into a steel rebar cage therein.

16. The method of claim 1, wherein:

the building comprises a central concrete core wall structure with a tower elevator shaft and a central hydraulic machine in a center of a plurality of multi-stacked columns; and the at least one gateway support structure is assembled at ground level and then elevated by the cable hoist and attached to the plurality of multi-stacked columns and a central core wall at different levels.

17. The method of claim 16, further comprising:

vertically elevating by the central core hydraulic machine horizontal platforms that are assembled with steel rebar and girdles at the ground level, and attaching the horizontal platforms to the plurality of multi-stacked columns and the central concrete core wall;

wherein the open position of the at least one gateway support structure enables access of the horizontal platforms through the at least one gateway support structure.

18. The method of claim 17, wherein the at least one gateway support structure is replaced by floor platforms.

19. The method of claim 18, wherein the building is populated with floor platforms starting from a top of the building to a bottom of the building.

* * * * *